US008439470B2

(12) United States Patent
Sakai

(10) Patent No.: US 8,439,470 B2
(45) Date of Patent: May 14, 2013

(54) LIQUID EJECTING DEVICE

(75) Inventor: Katsunori Sakai, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 34 days.

(21) Appl. No.: 13/239,999

(22) Filed: Sep. 22, 2011

(65) Prior Publication Data

US 2012/0081437 A1 Apr. 5, 2012

(30) Foreign Application Priority Data

Sep. 30, 2010 (JP) ..... 2010-221337

(51) Int. Cl.
*B41J 29/38* (2006.01)

(52) U.S. Cl.
USPC ..... 347/14; 347/13

(58) Field of Classification Search ..... 347/13, 347/14, 19, 16
See application file for complete search history.

(56) References Cited

U.S. PATENT DOCUMENTS

| | | | |
|---|---|---|---|
| 2003/0085962 | A1 | 5/2003 | Junhua |
| 2005/0140704 | A1 | 6/2005 | Mitsunaga et al. |
| 2007/0024663 | A1 | 2/2007 | Yamanobe |
| 2008/0225314 | A1 | 9/2008 | Fukasawa et al. |

FOREIGN PATENT DOCUMENTS

| | | | |
|---|---|---|---|
| JP | H08-118736 | A | 5/1996 |
| JP | 2003-118113 | A | 4/2003 |
| JP | 2003-285476 | A | 10/2003 |
| JP | 2004-174791 | A | 6/2004 |
| JP | 2004-291458 | A | 10/2004 |
| JP | 2005-186475 | A | 7/2005 |
| JP | 2006-150811 | A | 6/2006 |
| JP | 2007-030363 | A | 2/2007 |
| JP | 2007-276147 | A | 10/2007 |
| JP | 2008-221713 | A | 9/2008 |
| JP | 2009-018527 | A | 1/2009 |

*Primary Examiner* — Julian Huffman
(74) *Attorney, Agent, or Firm* — Baker Botts L.L.P.

(57) ABSTRACT

A liquid ejecting device to eject droplets of liquid onto a recording medium is provided. The image ejecting device includes a recording medium conveyer, a liquid ejecting head, a detector unit, an image data storage, a controller, and a cancellation signal output unit to output cancellation signals in an error condition. The controller includes a creating unit to create first dot pattern data and sum segments extracted from the first dot pattern data to create second dot pattern data, a transmission unit, and a cancellation controller unit to stop the creating unit, create second dot pattern data by adding a dot pattern to the segments having been extracted from the first dot pattern data, and transmit the created second dot pattern data to the transmission unit. The controller controls the liquid ejecting head to eject the droplets from the nozzles according to the second dot pattern data.

5 Claims, 9 Drawing Sheets

LIQUID EJECTING DEVICE

CROSS REFERENCE TO RELATED APPLICATION

This application claims priority from Japanese Patent Applications No. 2010-221337, filed on Sep. 30, 2010, the entire subject matter of which is incorporated herein by reference.

BACKGROUND

1. Technical Field

An aspect of the present invention relates to a liquid ejecting device having a liquid ejecting head with a plurality of nozzles, from which droplets of liquid are ejected.

2. Related Art

An inkjet printer to print an image on a sheet of recording medium in ink, having an inkjet head with a plurality of nozzles, is known. The plurality of nozzles in the inkjet head may be arranged side-by-side along an orthogonal direction with respect to a direction to convey the sheet. The inkjet printer ejects droplets of ink from the nozzles onto the sheet to print the image. When the sheet is shorter in the sheet-conveying direction than the image being printed, and when the inkjet printer detects an end of the sheet in the sheet-conveying direction before completion of printing the image, the inkjet printer may control the inkjet head to stop ejecting the ink droplets from each nozzle at once to abort the printing operation, because continued printing operation beyond the lengthwise end of the sheet may ruin components in the inkjet printer by the ejected ink.

SUMMARY

Meanwhile, in order to achieve higher printing resolution, the nozzles in the inkjet head may be aligned side-by-side along the orthogonal direction in a plurality of multiplied lines, which are laid out mutually in parallel with one another along the sheet-conveying direction, i.e., in a form of matrix. With the nozzles aligned side-by-side along the orthogonal direction in the multiple laid-out lines, when the printing operation is incompletely aborted due to the shortage of the sheet length, in an image-printable area on the sheet, in which the lastly-ejected droplets are applied, the image having been printed by the time of abortion may include an incomplete unclear portion formed in the insufficient ink due to cancellation of ejecting the droplets from all the nozzles although the printable area may be yet acceptable of ejected droplets.

In view of the above drawback, the present invention is advantageous in that a liquid ejecting device, which can prevent printing the partially-unclear image in the lastly-formed image area, even when the image printing operation is aborted, is provided.

According to an aspect of the present invention, a liquid ejecting device, which is configured to eject droplets of liquid onto a surface of a recording medium to record an image, is provided. The liquid ejecting device includes a conveyer, which is configured to convey the recording medium in a conveying direction, a liquid ejecting head, which includes a plurality of nozzle lines laid out along the conveying direction, each of the nozzle lines including a plurality of nozzles being aligned to an orthogonal direction with respect to the conveying direction, the plurality of nozzles in adjoining nozzle lines being arranged in mutually different positions along the orthogonal direction, a detector unit, which is configured to detect a rear end of the recording medium being conveyed passing by a predetermined position, the predetermined position being in an upstream position with respect to the liquid ejecting head along the conveying direction, an image data storage, which is configured to store image data representing the image to be recorded, the image data including dot data, which represents dots to form the image, each of the dots corresponding to a plurality of pixels in the image data arranged in matrix, a controller, which controls the liquid ejecting head to eject the droplets of liquid from the nozzles at a predetermined timing, and a cancellation signal output unit, which is configured to output cancellation signals to stop ejecting the droplets from the nozzles before the rear end of the recording medium reaches a position opposite from one of the nozzles being arranged in a most upstream position along the conveying direction when an error condition, in which the dots corresponding to the pixels included in the image data are not completely recorded on the recording medium, is recognized. The controller includes a creating unit, which is configured to create a plurality of pieces of first dot pattern data based on a plurality of pieces of line data including dot data representing pixels arranged along the orthogonal direction amongst the plurality of pixels in matrix, the first dot pattern data representing the dots rearranged to reflect arrangement of the nozzles, and sum segments extracted from each of the plurality of pieces of the first dot pattern data on basis of a timing to eject the droplets to create a plurality of pieces of second dot pattern data, a transmission unit, which is configured to transmit the second dot pattern data on basis of the timing to the liquid ejecting head, and a cancellation controller unit, which is configured to stop the creating unit creating the first dot pattern, create at least a piece of second dot pattern data by adding a dot pattern, which omits the ejection of the droplets from the nozzles, to the segments having been extracted from the first dot pattern data by the creating unit, and transmit the created second dot pattern data to the transmission unit. The controller controls the liquid ejecting head to eject the droplets from the nozzles at the predetermined timing according to the second dot pattern data transmitted from the transmission unit.

According to the above-described configuration, when the cancellation signals are output upon occurrence of an error, the second dot pattern data is created by adding a dot pattern, which does not involve ejection of the droplets from the nozzles, to the segmented first dot pattern having been extracted. According to the second dot pattern data including the dot pattern, the droplets are ejected from the nozzles. Therefore, even when an image recording is aborted doe to the error, the image recording operation is aborted on basis of the line data, and liquid loss at least in the line in the image can be prevented.

BRIEF DESCRIPTION OF THE ACCOMPANYING DRAWINGS

DETAILED DESCRIPTION

Hereinafter, an embodiment of the present invention will be described with reference to the accompanying drawings.

Figure 1:
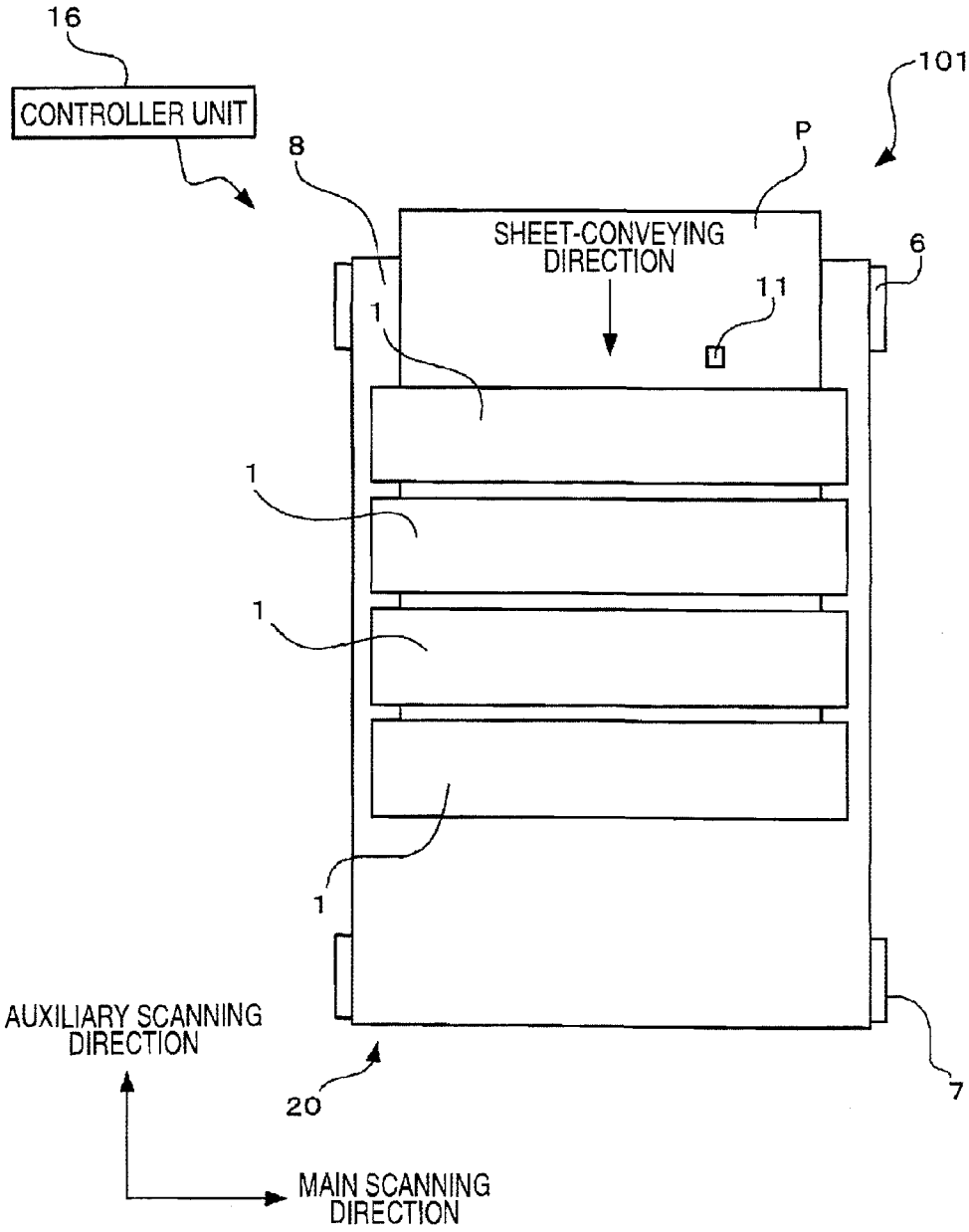
FIG. 1 is a schematic top plane view of an inkjet printer according to an embodiment of the present invention.

An inkjet printer 101 being a line printer includes a conveyer unit 20, four inkjet heads 1, and a controller unit 16. The conveyer unit 20 conveys a sheet P being an image recording medium in a sheet-conveying direction, which is from top to bottom in FIG. 1, indicated by a downward arrow. Each of the inkjet heads 1 ejects droplets of one of different colored inks, which are, for example, black, magenta, cyan, and yellow. The controller unit 16 controls overall behaviors of the inkjet printer 101. In the present embodiment, the sheet-conveying direction is in parallel with an auxiliary scanning direction of the inkjet printer 101, whereas a main scanning direction is a direction orthogonal to the sheet-conveying direction and in parallel with a horizontal plane.

The conveyer unit 20 includes a pair of belt rollers 6, 7 and an endless conveyer belt 8, which rolls around the belt rollers 6, 7. The belt roller 7 is a driving roller, which is rotated by driving force from a conveyer motor (not shown). The belt roller 6 is a driven roller, which is rotated along with the conveyer belt 8 being rolled by the rotation of the belt roller 7. The sheet P on an upper outer surface of the conveyer belt 8 is carried along the sheet-conveying direction according to the rolling movement of the conveyer belt 8. The upper outer surface of the conveyer belt 8 includes a flushing area (not shown), which is extended along a widthwise direction (i.e., in parallel with the main scanning direction).

The four inkjet heads 1 are arranged along the main scanning direction and laid out in parallel with one another along the auxiliary direction. The inkjet printer 101 is a line printer for multiple colors, and each of the four inkjet heads 1 ejects droplets of an ink in one of the different four colors. The inkjet head 1 includes bottom surface being a nozzle surface 2*a*, in which a plurality of nozzles 108 are formed (see FIGS. 3 and 4).

In the inkjet printer 101, the inkjet heads 1 are arranged to be in parallel with the upper outer surface of the conveyer belt 8 with the nozzle surfaces 2*a* facing the upper outer surface of the conveyer belt 8. When the sheet P being carried on the conveyer belt 8 passes the position below the inkjet heads 1, the inkjet heads 1 eject the ink droplets onto the surface of the sheet P to form the image in the colored inks.

The inkjet printer 101 has a sheet sensor 11, which detects presence of the sheet P, arranged in an upstream position along the sheet-conveying direction with respect to the inkjet heads 1. More specifically, the sheet sensor 11 detects a front end and a rear end of the sheet P passing by the sheet sensor 11. In the present embodiment, a length of the sheet P ranging from the front end and the rear end along the sheet-conveying direction may be referred to as a "sheet length."

Figure 2:
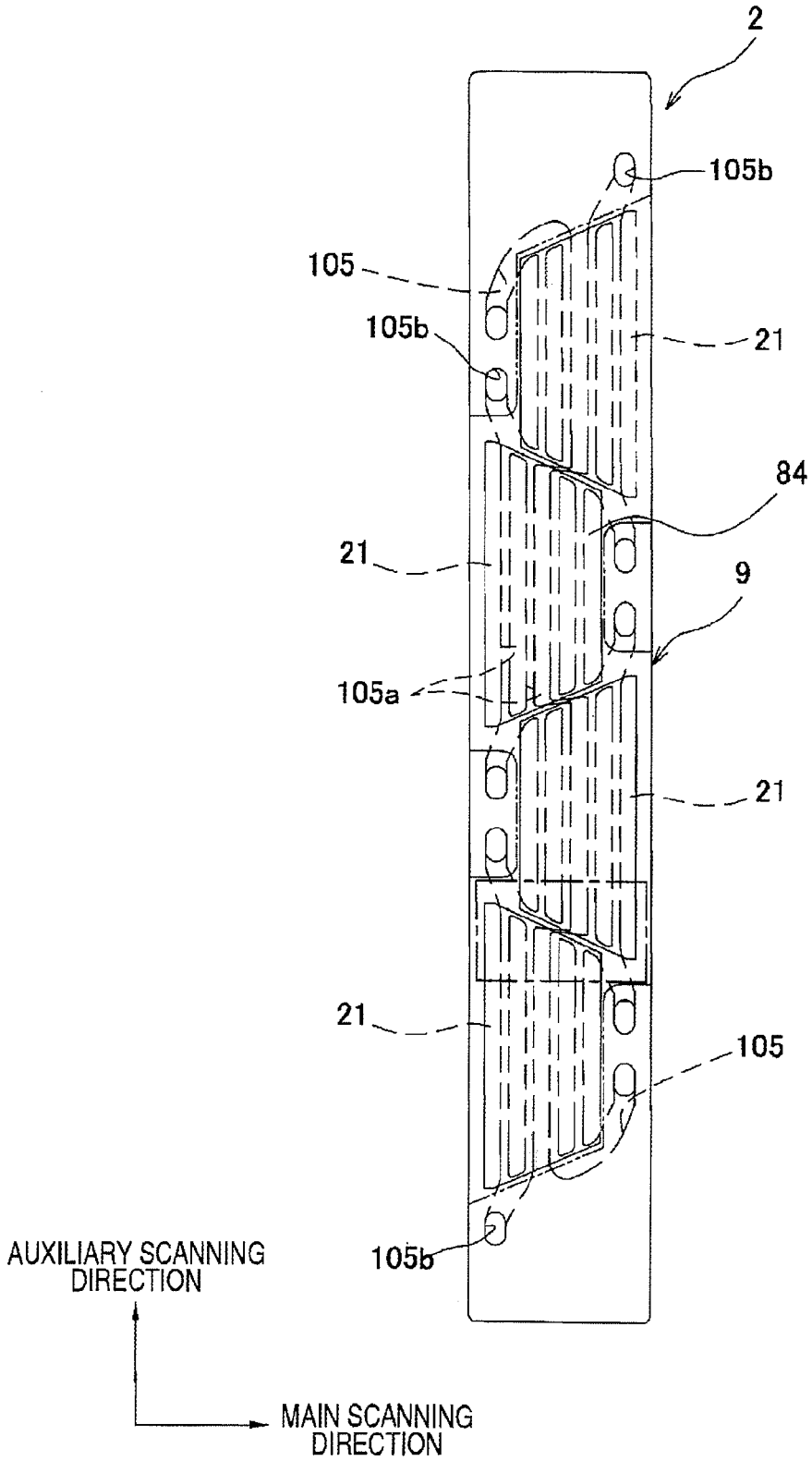
FIG. 2 is a plane view of a head of an inkjet-head in the inkjet printer according to the embodiment of the present invention.

Each of the inkjet heads 1 includes a head 2 (see FIG. 2). The head 2 will be described with reference to FIGS. 2-4. It is to be noted in FIG. 3 that pressure chambers 110, apertures 112, and the nozzles 108, which are in positions lower than actuator units 21 to be drawn in broken lines, are drawn in solid lines for the sake of expedience.

Figure 3:
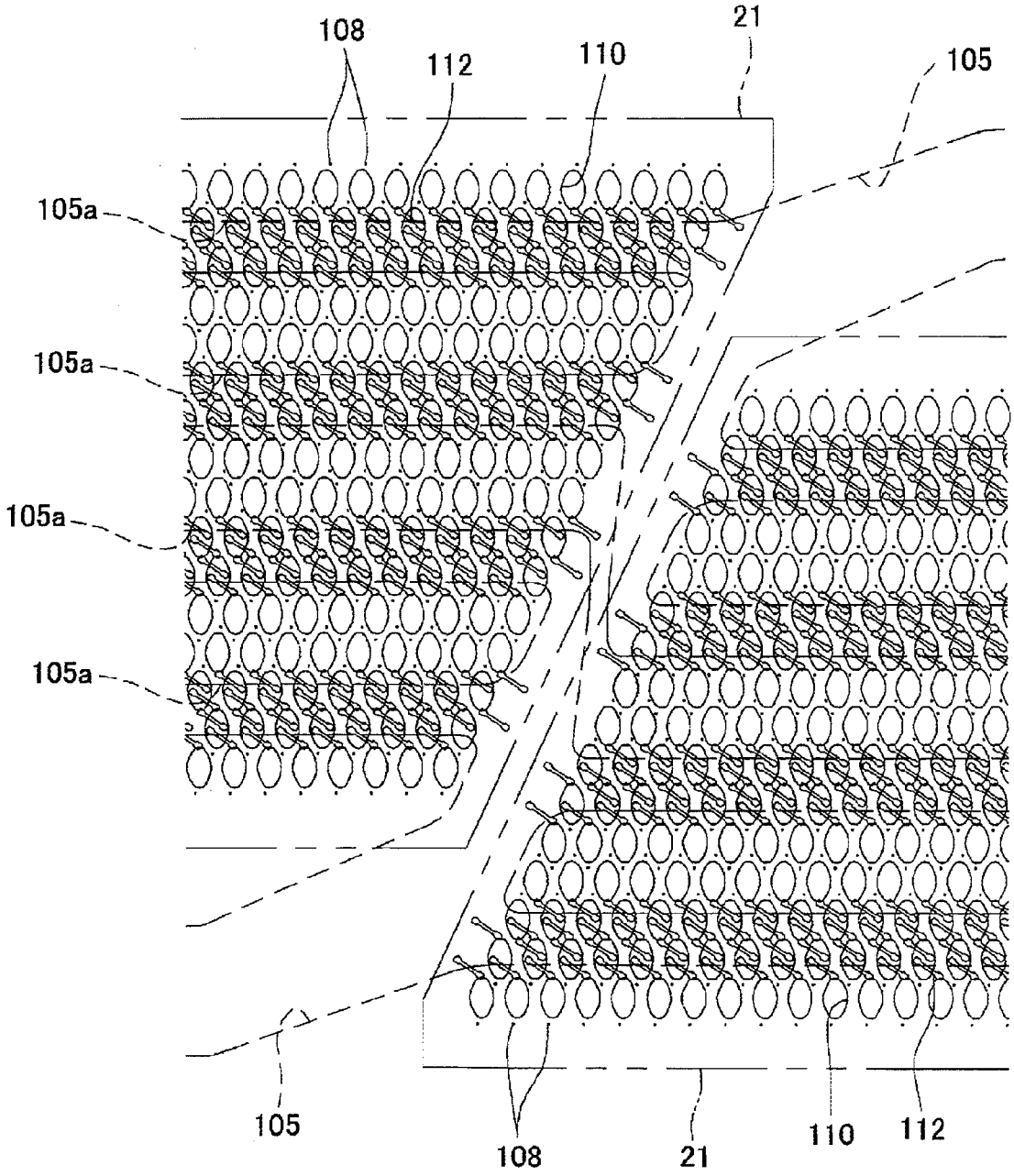
FIG. 3 is an enlarged partial view of an area in the head enclosed by a dotted line shown in FIG. 2.

The head 2 includes a fluid channel unit 9 in a lower section and actuator units 21 attached on top of the fluid channel unit 9 (see FIG. 3). The fluid channel unit 9 is formed to have ink channels inside, which includes pressure chambers 110. The actuator unit 21 includes a plurality of unimorph-typed actuators, each of which is in a position to correspond to one of the pressure chambers 110. The actuators selectively apply pressure to the ink in the pressure chambers 110 to have the ink to be ejected in droplets by the pressure onto the sheet P.

The fluid channel unit 9 includes a plurality of laminated metal (e.g., stainless steel) plates 122-130, which are arranged to be in correct positions with respect to one another. On a top surface of the fluid channel unit 9, a plurality of ink supply holes 105*b*, which are in fluid communication with an ink reservoir (not shown), are formed. In the fluid channel unit 9, manifold channels 105, which are in fluid communication with the ink supply holes 105*b*, and subsidiary manifold channels 105*a*, which are included in the manifold channels 105. Further, the fluid channel unit 9 is formed to have branched ink channels 132, which diverge from the subsidiary manifold channels 105*a* to be in fluid communication with the nozzles 108, which are formed in the nozzle surface 2*a*, via the pressure chambers 110. In other words, the branched ink channels 132 connect the subsidiary manifold channels 105*a* with the nozzles 108. On the nozzle surface 2*a*, the nozzles 108 are formed to align side-by-side in a plurality of lines extending along the main scanning direction, when the inkjet head 1 is installed in the inkjet printer 101, to form nozzle lines. Meanwhile, the plurality of nozzle lines are laid out along the auxiliary scanning direction. The nozzles 108 in different nozzle lines are formed in mutually not-overlapping different positions from one another along the auxiliary scanning direction. Meanwhile, the nozzles 108 are formed in mutually not-overlapping different positions from one another along the main scanning direction within the respective nozzle lines. In other words, the nozzles 108 are formed in separated positions in a same plane without, in the direction of main scanning, horizontally overlapping one another.

Figure 4:
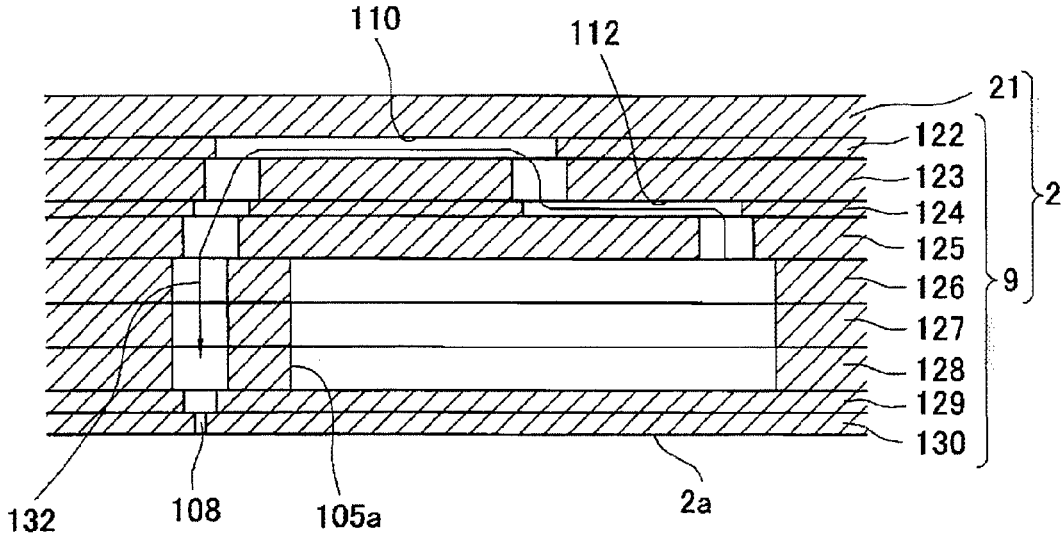
FIG. 4 is a cross-sectional partial view of the head in the inkjet head of the inkjet printer according to the embodiment of the present invention.

Flows of the ink in the fluid channel unit 9 will be described below with reference to FIG. 4. The ink conveyed to the ink supply holes 105*b* is distributed in the subsidiary manifold channels 105*a* in the manifold channels 105. The ink in the subsidiary manifold channels 105*a* is introduced to the branched ink channels 132 via the apertures 112 and the pressure chambers 110 and forwarded to the nozzles 108.

Figure 5:
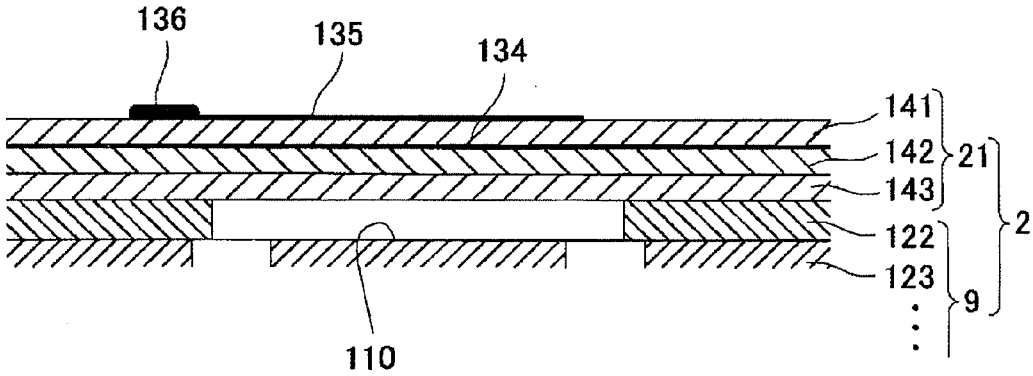
FIG. 5 is a cross-sectional partial view of an actuator unit of the head in the inkjet printer according to the embodiment of the present invention.

The actuator unit 21 will be described below with reference to FIG. 5. The actuator unit 21 is a piezoelectric actuator, which includes three piezoelectric layers 141-143 made of, for example, ceramic materials such as ferroelectric lead zirconium titanate (PZT). A topmost piezoelectric layer 141 is polarized in a direction of thickness of the layer, and a plurality of separate electrodes 135 are formed in a top surface of the topmost piezoelectric layer 141. Meanwhile, a sheet of common electrode 134 is interposed between the topmost piezoelectric layer 141 and an intermediate piezoelectric layer 142. Thus, the plurality of separate electrodes 135 and the common electrode 134 hold the topmost piezoelectric layer 141 in between them.

The separate electrodes 135 are arranged in positions opposite from the pressure chambers 110. Each of the separate electrodes 135 is electrically connected with a land 136.

When electric field in the direction of the polarization is impressed to the topmost piezoelectric layer 141, with potential of the separate electrodes 135 maintained to be different from potential of the common electrode 134, an area of the electric field in the topmost piezoelectric layer 141 deforms to serve as an activator. In this regard, potential of the common electrode 134 is maintained at a reference level. Accordingly, a portion interposed between the separate electrode 135 and the pressure chamber 110 actuates to move the ink in the pressure chamber 110. Thus, the actuator unit 21 serves as a piezoelectric actuator having a plurality of actuators, each of which corresponds to one of the pressure chambers 110 on one-on-one basis.

In the common electrode 134, the areas corresponding to the pressure chambers 110 respectively are equally provided with ground potentials whereas each of the separate electrode 135 is supplied with driving signals to deform the topmost piezoelectric layer 141 from the controller unit 16.

A mechanism to drive the actuator unit 21 will be described below. When, for example, the direction of polarization in the actuator unit 21 is similar to the direction of impression of the electric field, the potential-impressed area being the activator deforms in a direction perpendicular to the direction of polarization, i.e., horizontally. Meanwhile, the actuator unit 21 is a unimorph-typed actuator including the activator layer (i.e., the topmost piezoelectric layer 141) being separated from the pressure chamber 110 and two inactive lower piezoelectric layers 142, 143 which are closer to the pressure chamber 110. Whilst the piezoelectric layers 141-143 are fixed to a top surface of a plate 122, which has the pressure chamber 110, when the potential-impressed areas horizontally deform differently from the lower piezoelectric layers 142, 143, the entire piezoelectric layers 141-143 deform to protrude inside the pressure chamber 110 (unimorph deformation). The deformed piezoelectric layers 141-143 apply pressure to the ink in the pressure chamber 110 to be ejected in a droplet through the nozzle 108.

In the present embodiment, potential is initially impressed to the separate electrodes 135 in order to maintain potential of the separate electrodes 135 at a predetermined level. With the impressed potential, the piezoelectric layers 141-143 are deformed from their original condition toward the pressure chambers 110. From the deformed condition, when signals for ejecting of the ink are inputted, the potential of the requested separate electrode 135 is once set to ground. Accordingly, the piezoelectric layers 141-143 recover to their undeformed original condition, and a volume inside the pressure chamber 110 increases with respect to an initial volume, which is produced by the deformation of the potential-impressed piezoelectric layers 141-143. Therefore, the ink is pumped from the subsidiary manifold channel 105*a* to the branched ink channel 132. Thereafter, potential is impressed to the separate electrode 135 based on driving signals to impress the potential to the predetermined level at a predetermined timing, and the potential-impressed area being the activator of the piezoelectric layers 141-134 is deformed to protrude inside the pressure chamber 110. Accordingly, pressure in the ink is increased, and the ink is ejected through the nozzle 108 in a droplet.

Figure 6:
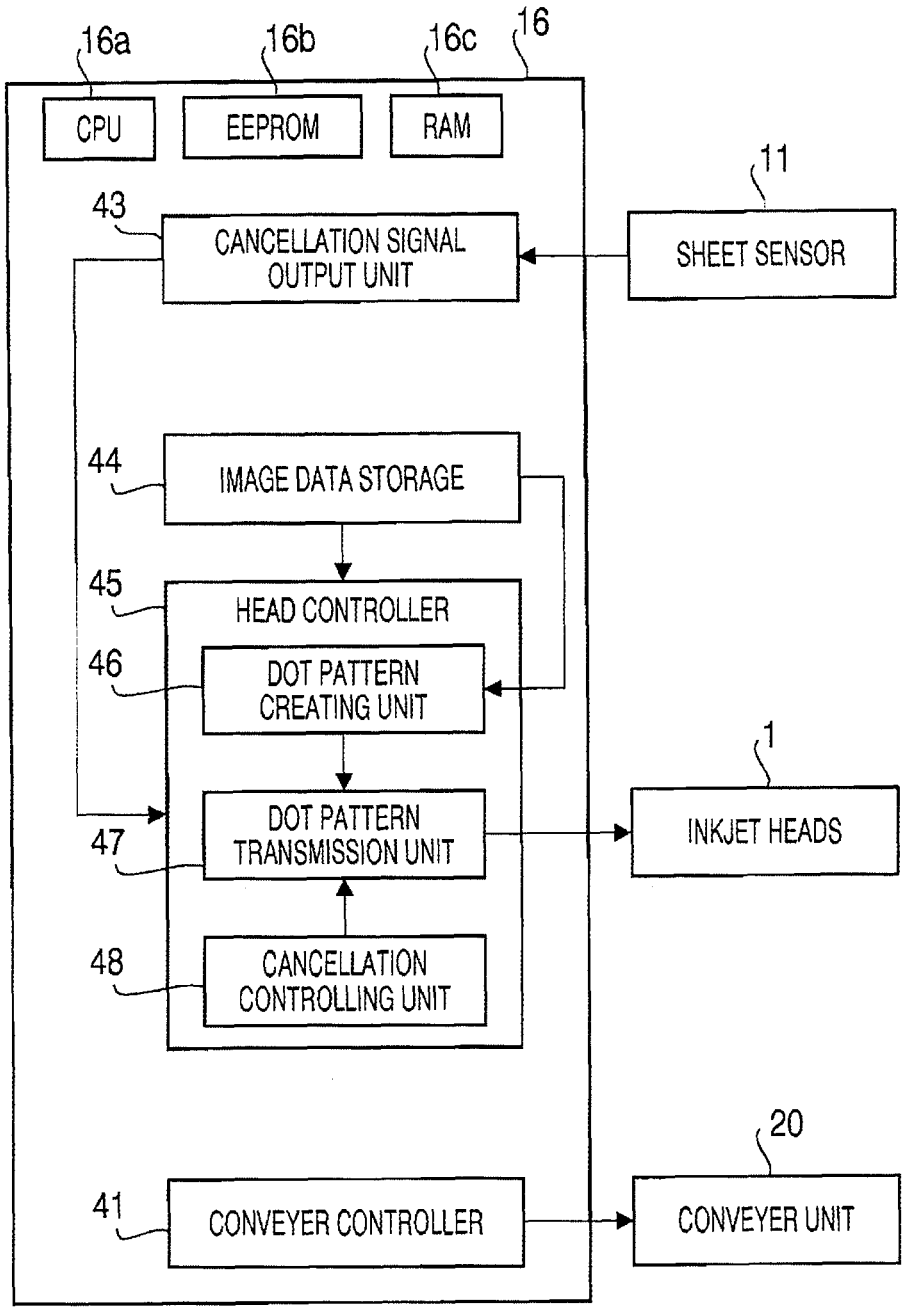
FIG. 6 is a block diagram to illustrate components in a controller unit in the inkjet printer according to the embodiment of the present invention.

The controller unit 16 will be described below with reference to FIG. 6. The controller unit 16 includes a central processing unit (CPU) 16*a*, an electrically erasable and programmable read only memory (EEPROM) 16*b*, and a random access memory (RAM) 16*c*, which are connected with one another and with each of components in the controller unit 16 described below (conductive lines to indicate the connection are omitted in FIG. 6). The CPU 16*a* executes arithmetic operations, and the EEPROM 16*b* is a rewritable memory to store controlling programs and instructions to be executed by the CPU 16*a* and data to be used in the controlling programs. The RAM 16*c* temporarily stores data to be used in the controlling programs when the programs are active. Thus, the components in the controller unit 16, including the hardware and the software programs stored in the EEPROM 16*b*, work in cooperation with one another to achieve functionality of the inkjet printer 101. The components in the controller unit 16 include a conveyer controller 41, an image data storage 44, a cancellation signal output unit 43, and a head controller 45.

The conveyer controller 41 controls a conveyer motor (not shown) of the conveyer unit 20 to have the sheet P conveyed in a predetermine speed along the sheet-conveying direction.

The image data storage 44 stores image data, which represents an image to be printed on the sheet P and includes dot data. The dot data contains information concerning dots, each of which is printed for one of pixels arranged in matrix in the image data, to form the image on the sheet P. In particular, the image data includes a plurality of pieces of line data LD1-LD3 (see FIG. 7), each of which includes dot data representing a plurality of pixels aligned along the main scanning direction. In other words, the image is divided into lines, and each of the line data LD1-LD3 represents one of the lines, each of which includes the dot data representing the dots to be formed in the line.

The cancellation signal output unit 43 can detect an error concerning the length of the sheet P. More specifically, when the sheet sensor 11 detects the rear end of the sheet P passing by the sheet sensor 11, and when a count of pieces line data, which includes dot data representing dots not yet printed on the sheet P, is greater than a count of pieces of line data for dots to be printed in a remaining printable range in the sheet P, the cancellation signal output unit 43 recognizes an error. The remaining printable range in the sheet P refers to an area in a page of the sheet P, which can accept at least a part of the image to be formed but does not include a predetermined margin. Therefore, in the error condition, the image would not fit in the printable range on the sheet P being conveyed by the conveyer unit 20, and the dots to form the image being printed in the printing operation would not be entirely accepted in the printable range. In this regard, the cancellation signal output unit 43 outputs cancellation signals to stop ejecting the ink droplets from the nozzles to abort the printing operation. According to the present embodiment, the cancellation signal output unit 43 is configured to output the cancellation signals in a specific timing, which is before a rear end of the printable range, excluding the margin, in the sheet P being conveyed reaches a position opposite from the nozzles 108 being arranged in most upstream positions along the sheet-conveying direction.

The head controller 45 controls behaviors of the four inkjet heads 1 ejecting the inks from the nozzles 108. The head controller 45 includes a dot pattern creating unit 46, a dot pattern transmission unit 47, and a cancellation controlling unit 48. The behaviors of the inkjet heads 1 controlled by the head controller 45 will be described below with reference to FIG. 7. In the description below, three nozzle lines, which extend along the main scanning direction in the nozzle surface 2*a*, represent the plurality of nozzle lines including the nozzles 108 in each of the inkjet heads 1. It is to be noted, however, that a quantity of the nozzle lines is not limited to three but may be greater or smaller than three. The three nozzle lines are laid out along a line in parallel with the auxiliary scanning direction to be evenly spaced apart from an adjoining nozzle line. Further, in the following example, a time period, in which the sheet P is conveyed for the space between the nozzle lines, will be referred to an ejection period, which defines timing for the inkjet head 1 to eject the ink.

Figure 7:
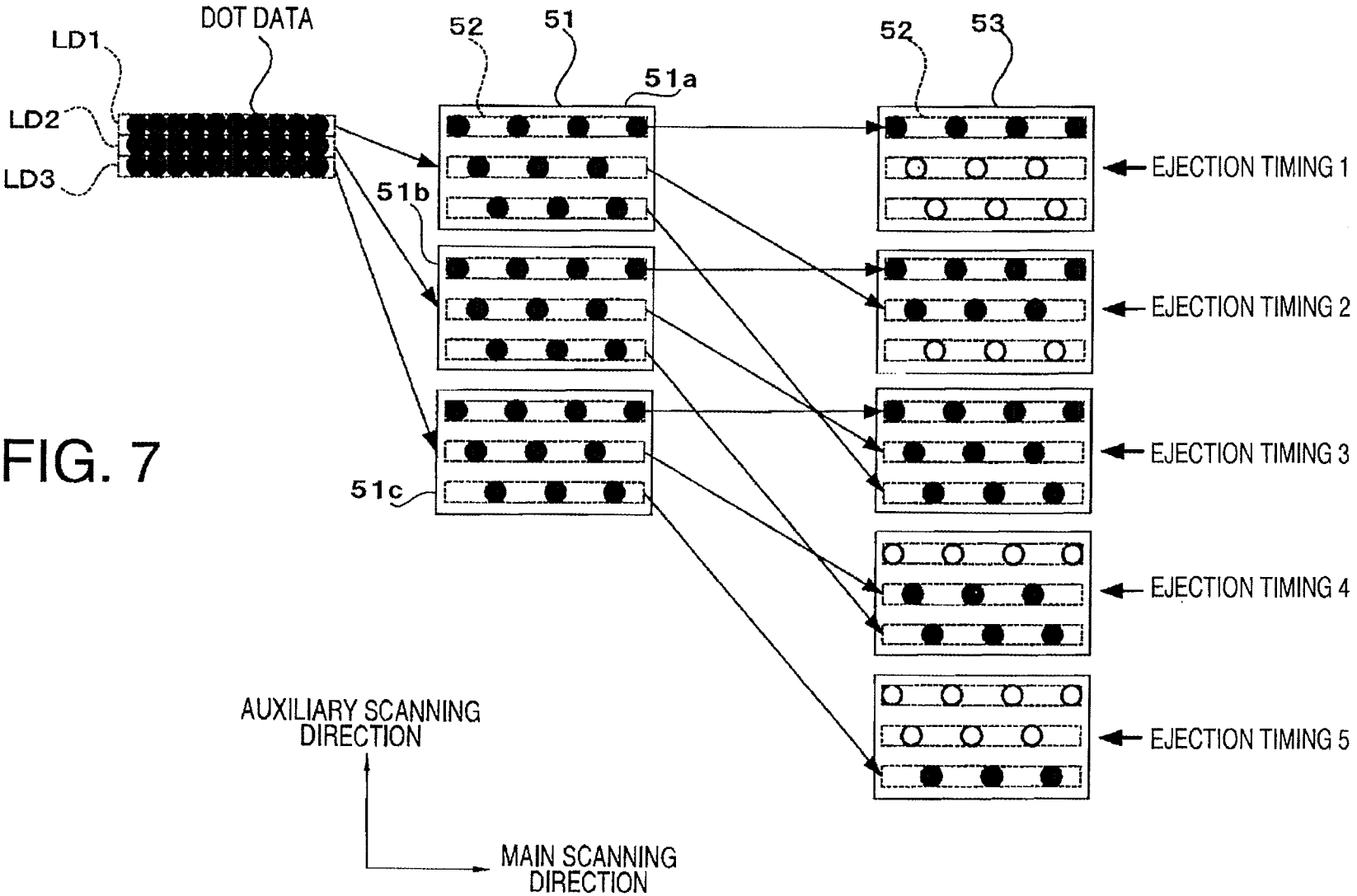
FIG. 7 is a diagram to illustrate a flow to create first and second dot pattern data in a dot pattern creating unit in the controller unit in the inkjet printer according to the embodiment of the present invention.

According to the present embodiment, the dot pattern creating unit 46 extracts line data LD1-LD 3, which includes dot data, from the image data for each of the inkjet heads 1 (see FIG. 7). The dot data in each of the extracted line data LD1-LD3 represents the dots to be printed to form a line in the image on the sheet P. Based on the extracted line data LD1-LD3, the dot pattern creating unit 46 creates first dot pattern data 51 including first dot pattern data 51*a*, 51*b*, 51*c* for each of the extracted line data LD1-LD3. In particular, in the first dot pattern data 51, the dot data representing the dots is rearranged to reflect arrangement of the nozzles 108 in one of the nozzle lines. In this regard, a line to be formed based on the line data LD1/LD2/LD3 is completed in three ejecting operations, which are conducted at three different ejection timings. In the present example, a line to be formed based on the line data LD1 is completed in three ejecting operations, which are conducted at ejection timings t1, t2, and t3. A line to be formed based on the line data LD2 is completed in three ejecting operations, which are conducted at ejection timings t2, t3, and t4. A line to be formed based on the line data LD3 is completed in three ejecting operations, which are conducted at ejection timings t3, t4, and t5. Therefore, in the first dot pattern data 51, the dot data is resolved into three segments 52, each of which includes the dots to be printed at a time on the sheet P, on basis of the ejection timing.

The dot pattern creating unit 46 extracts the segmented dot pattern data 52 for the ejection timing t1, which represents the dots to be formed at the ejection timing t1, from the first dot pattern data 51. Further, the dot pattern creating unit 46 similarly extracts the segmented dot pattern data 52 for the ejection timings t2-t5 respectively. The pieces of extracted segmented dot pattern data 52 are associated with the corresponding nozzle lines and with ejection timing t1-t5 and stored in a memory area in the RAM 16*c*. Further, the dot pattern creating unit 46 collects the extracted segmented dot pattern data 52 on basis of the ejection timing t1-t5 and sums the collected extracted segmented dot pattern data 52 to create second dot pattern data 53. In the present example shown in FIG. 7, three pieces of segmented dot pattern data 52 for the same ejection timing are summed to create a piece of second dot pattern data 53. Therefore, the second dot pattern data 53 includes the segmented dot pattern data 52 for each of the ejection timings t1-t5 for all the nozzle lines in the inkjet head 1. In other words, the second dot pattern data 53 includes the dot data for all the nozzles 108 in the inkjet head 1 to eject the ink at the ejection timings t1-t5.

The dot pattern transmission unit 47 transmits the second dot pattern data 53 created for the ejection timings t1-t5 to the inkjet heads 1. Based on the second dot pattern data 53 transmitted to the inkjet heads 1, the controller unit 16 controls the inkjet head 1 to eject the inks in dots from the nozzles 108.

Figure 8:
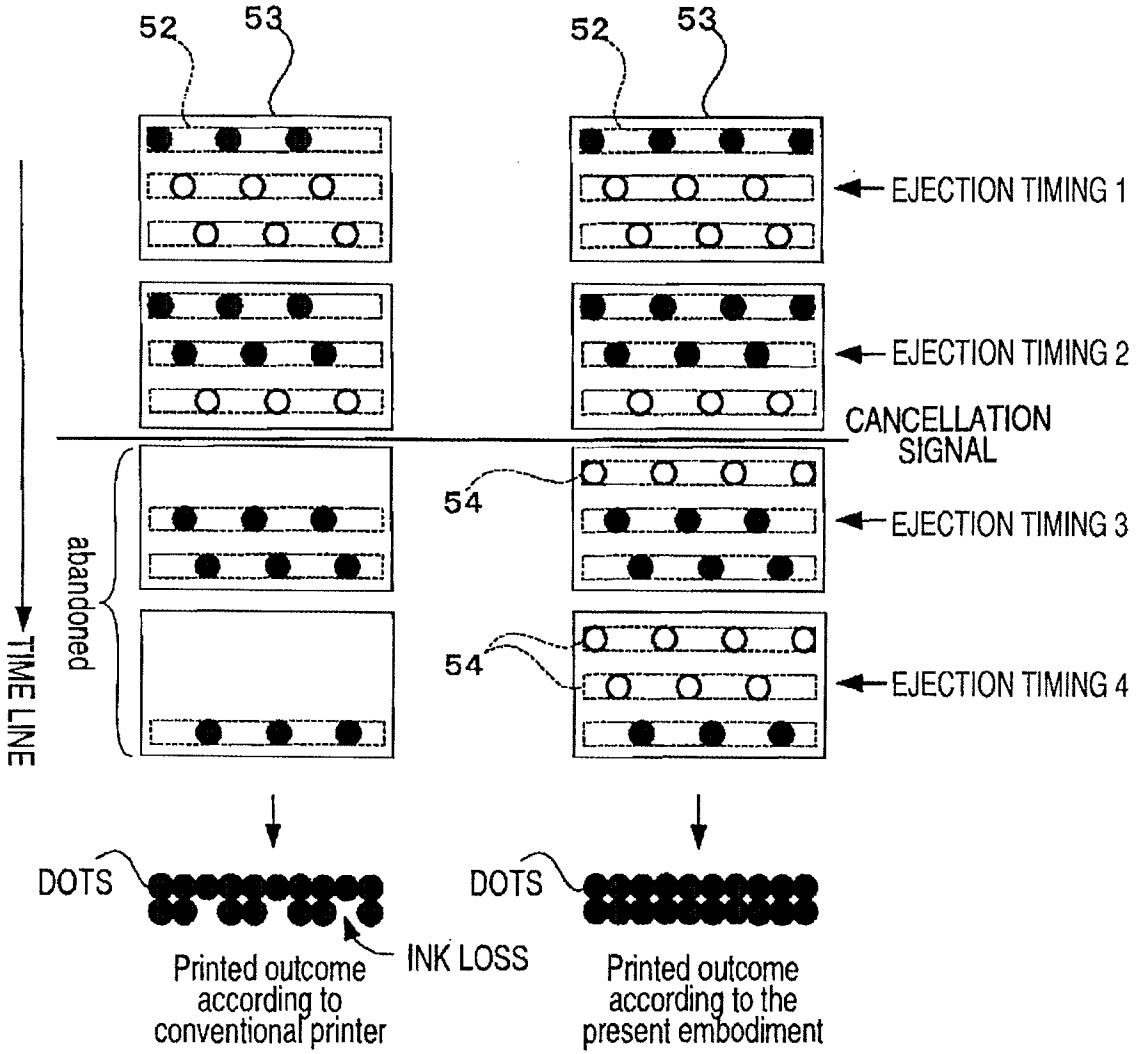
FIG. 8 is a diagram to illustrate a flow of cancelling a printing unit in a cancellation processing unit in the controller unit in the inkjet printer according to the embodiment of the present invention.

Behaviors of the cancellation controlling unit 48 will be described with reference to FIG. 8. The cancellation controlling unit 48 controls the dot pattern creating unit 46 to stop creating the first dot pattern data 51 when an error occurs and when cancellation signal output unit 43 outputs cancellation signals. In the present example shown in FIG. 8, the error occurs at a timing between the ejection timing t2 and the ejection timing t3. The cancellation controlling unit 48 creates empty dot pattern 54 in place of segmented dot pattern data 52, which is to be used to form the dots at the scheduled ejection timings t3, t4 but not yet extracted from the image data. The empty dot pattern 54 includes dot data, which does not involve ink ejecting from the nozzles 108. Further, the cancellation execution unit 48 adds the created empty dot pattern 54 to the segmented dot pattern data 52, which has been already created by the dot pattern creating unit 46 for the scheduled ejection timings t3, t4, to create the second dot pattern data 53. The second dot pattern data 53 created by the cancellation controlling unit 48 is transmitted to the inkjet head 1 by the dot pattern transmission unit 47.

Further, when the line data is regularly processed to form the lines and a line count of remaining (unprinted) line data is decreased to zero, the cancellation controlling unit 48 creates the empty dot pattern 54 for the ejection timing, similarly to the error condition described above. Further, the cancellation controlling unit 48 adds the created empty dot pattern 54 to the segmented dot pattern data 52 already created by the dot pattern creating unit 46 to create the second dot pattern data 53. The second dot pattern data 53 created by the cancellation controlling unit 48 is transmitted to the inkjet head 1 by the dot pattern transmission unit 47.

In the conventional inkjet printer, which aborts the printing operation upon occurrence of an error, ink loss to make a part of the image appear unclear can be caused in the printed outcome. More specifically, when the error occurs and the cancellation signals are output, the printing operation is aborted, and ejecting of droplets of ink is abandoned. When ejecting of droplets is abandoned incomplete, no further droplets of ink are ejected, and the incomplete ink ejecting causes the ink loss in the line the printed outcome. Therefore, ink droplets standing by for the abandoned part of the segmented dot pattern data 52, which has been extracted from the line data, are left unejected in the inkjet head 1 to cause the ink loss. On the other hand, according to the inkjet printer 101 of the present embodiment, all the segmented dot pattern data 52 included in the line data is transmitted to the inkjet head 1 along with the empty dot pattern 54 after the output of the cancellation signals. Therefore, regardless of the cancellation of the printing operation, the dots are printed on basis of the line, and the ink loss can be prevented from being caused.

Figure 9:
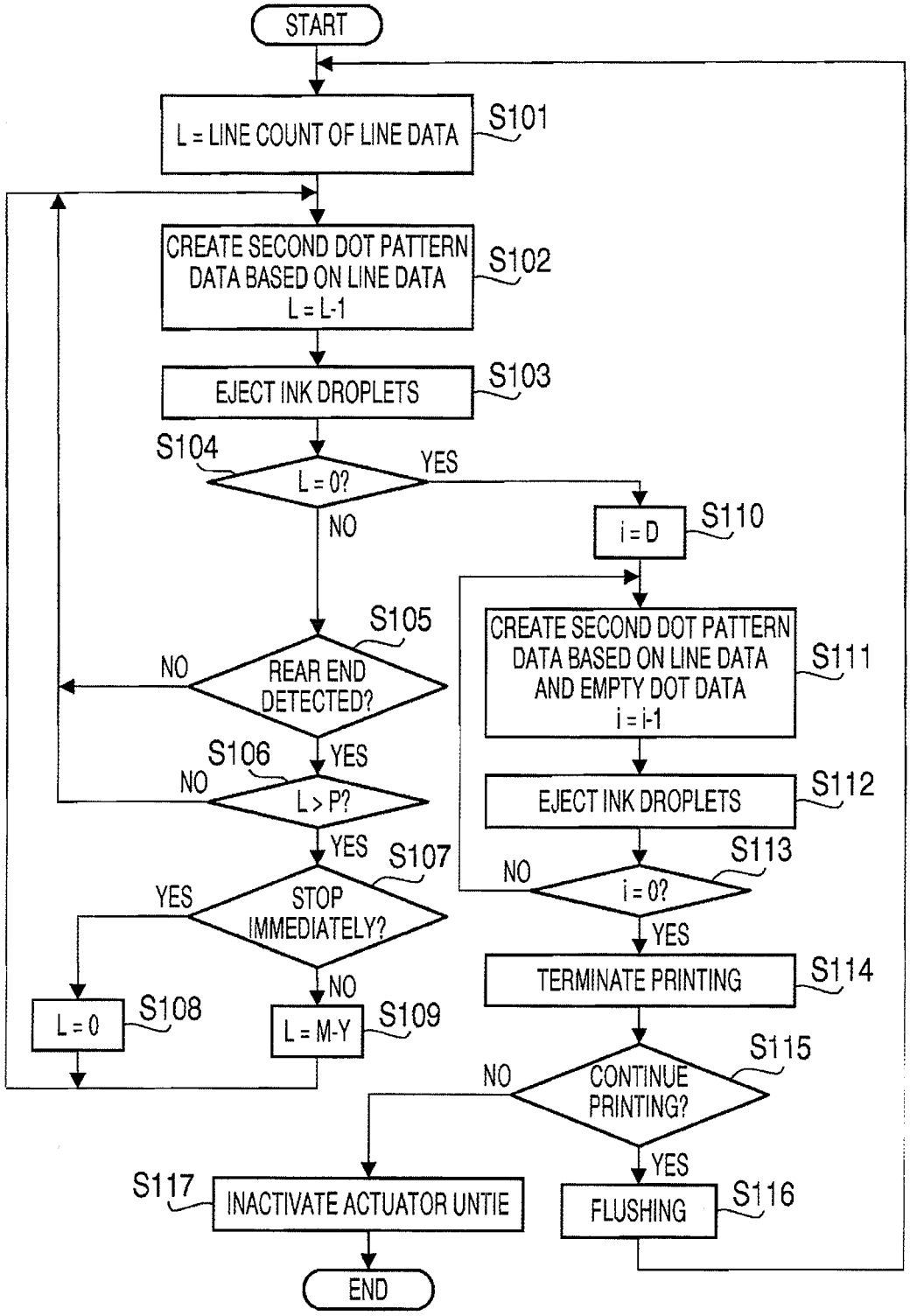
FIG. 9 is a flowchart to illustrate behaviors of the inkjet printer according to the embodiment of the present invention.

A flow of the behaviors of the inkjet printer 101 to print the dots described above will be explained in detail with reference to FIG. 9. The flow starts when a print job is inputted and a printing operation is activated. When the flow starts, in S101, the cancellation signal output unit 43 initializes a line count L of remaining line data to a count of pieces of line data obtained in the image data. In S102, the dot pattern creating unit 46 extracts a piece of line data, which is to be processed to eject ink droplets from the nozzles 108 at a next scheduled ejection timing, from the image data. Further, the dot pattern creating unit 46 creates the first dot pattern data 51 for the extracted line data and collects the segmented dot pattern data 52 including the dots to be ejected at a same ejection timing from the created first dot pattern data 51. The collected segmented dot pattern data 52 is summed to create the second dot pattern data 53. The second dot pattern data 53 is transmitted to the inkjet head 1 by the dot pattern transmission unit 47. Furthermore, the line count L of remaining line data is decremented by one. In S103, the inkjet head 1 ejects droplets of the ink from the nozzles 108 according to the second dot pattern data 53 to print the dots on the sheet P.

In S104, the line count L of remaining line data is examined, and it is judged as to whether the line count L is zero. When the line count L is not zero (S104: NO), in S105, the cancellation output unit 43 judges as to whether the sheet sensor 11 detects the rear end of the sheet P. If the sheet sensor 11 does not detect the rear end of the sheet P (S105: NO), the flow returns to S102 and repeats S102-S104 to process a next piece of line data. If the sheet sensor 11 detects the rear end (S105: YES), in S106, the cancellation signal output unit 43 examines the line count L of remaining line data and judges as to whether the line count L exceeds a count M of pieces of line data, which are acceptable to fit in a printable range of the sheet P. If the line count L of remaining line data does not exceed the line count M of acceptable line data (S106: NO), the flow returns to S102 and repeats S102-S105 to process a next piece of line data.

If the line count L of remaining line data exceeds the line count M of acceptable line data (S106: YES), the cancellation signal output unit 43 determines that an error occurred. In S107, the cancellation signal output unit 43 judges as to whether the error requires immediate cancellation of the printing operation based on configuration information concerning print settings. The print settings are preset by a user prior to starting the printing operation, and the user may or may not set the ongoing printing operation to be immediately canceled upon occurrence of the error. More specifically, the user may select that the ongoing printing operation is not to be cancelled immediately if a size of the image having been printed by the time of the error occurrence is greater than or a equal to a predetermined size, and the ongoing printing operation is to be cancelled immediately if a size of the image having been formed is smaller than the predetermined size. For example, if more than a half of the image has been printed by the time of error occurrence, the printing operation may not be cancelled immediately, but if less than a half of the image has been printed by the time of error occurrence, the printing operation may be cancelled immediately. The threshold size of the image to may be defined by the user's preference. In S107, if the print settings indicates that the printing operation should be cancelled immediately (S107: YES), in S108, the line count L of remaining line data is updated to be zero. The flow returns to S102 and repeats S102-S104. According to this flow, the printing operation is immediately cancelled upon occurrence of the error, and unnecessary consumption of the ink for the aborted printing operation can be effectively reduced. On the other hand, if the print settings indicates that the printing operation should not be cancelled immediately (S107: NO), an in-margin line count Y, which is a quantity of pieces of line data containable in the margin of the sheet P, is subtracted from the line count M of line data, which are acceptable to fit in the printable range of the sheet P. Thus, the line count L of remaining line data is obtained. The flow returns to S102 and repeats S102-104. According to this flow, the printing operation is not cancelled immediately but continued to print the line of image fitted in the printable range of the sheet P, which excludes the margin. Therefore, when a specific part of the image, which is required by the user, is included in the image printed in the printable range of the sheet P, the printed outcome may not necessarily become wasted, and the user may not necessarily try to print the same image again from the start. Thus, waste of the sheet P can be effectively avoided. The in-margin line count Y of pieces of line data may be determined according to the user's preference.

In S104, if the line count L of remaining line data is zero (S104: YES), in S110, the cancellation controlling unit 48 initializes a counter i to the frequency D of ejection timings. The frequency D is a number of ejection timings, at which the ink droplets are ejected from the nozzles 108 to process a piece of line data assigned to the inkjet head 1. In the above-described example, three ejection timings are set to complete a line of image; therefore, the counter i is set to 3. In S111, the cancellation output unit 43 creates the empty dot pattern 54 for a next scheduled ejection timing and adds the created empty dot pattern 54 to the segmented dot pattern data 52, which has been extracted in S102, to create the second dot pattern data 53. The second dot pattern data 53 is transmitted to the inkjet head 1 by the dot pattern transmission unit 47. Furthermore, the line count L of remaining line data is decremented by one. In S112, the inkjet head 1 ejects droplets of the ink from the nozzles 108 according to the second dot pattern data 53 to print the dots on the sheet P. In S113, the cancellation controlling unit 48 examines the counter i to judge as to whether the counter i indicates zero. If the counter i indicates a number greater than zero (S113: NO), the flow returns to S111 and repeats S111-S112 until the counter i indicates zero in S113. When the counter i indicates zero (S113: NO), in S114, the printing operation is terminated.

In S115, the controller unit 16 judges as to whether printing is continued for a new print job. When printing is continued (S115: YES), in S116, a flushing operation to maintain condition of the nozzles 108 is conducted. More specifically, ink droplets are collaterally ejected from all the nozzles 108 in the inkjet heads 1 onto the flushing area of the conveyer belt 8 in order to clear the nozzles 108. The flow returns to S101 to repeat the steps in FIG. 9 to process the printing operation.

When printing is discontinued (S115: NO), in S117, the controller unit 16 resets the potential of the separate electrodes 135 in the actuator units 21 to ground. Accordingly, the piezoelectric layers 141-143 are released, and the actuator units 21 are inactivated. The flow ends thereafter.

According to the inkjet printer 101 in the above-described embodiment, when an error occurs, the cancellation controlling unit 48 sums the empty dot pattern 54, by which no ink droplet is ejected, to the segmented dot pattern data 52, which has been already created by the dot pattern creating unit 46 for the scheduled ejection timings, to create the second dot pattern data 53. In this way, when the printing operation is aborted due to an error, the operation is cancelled on basis of line data. Therefore, ink loss at least in the line in the image can be prevented.

According to the inkjet printer 101 in the above-described embodiment, when the cancellation signal output unit 43 detects the sheet sensor 11 sensing the rear end of the sheet P, the count of pieces of line data, which are for the dots not yet printed on the sheet P, is greater than a count of pieces of line data for dots to be printed in a remaining printable range in the sheet P, the cancellation signal output unit 43 recognizes an error. In other words, the error condition can be detected in easy steps.

Further, according to the inkjet printer 101 in the above-described embodiment, the actuator units 21 are released from the potential after termination of the printing operation, unless a continuous printing operation is standing by. Therefore, deterioration of the piezoelectric layers 141-143 in the actuator units 21 can be moderated.

Further, with the flushing operation after completion of the printing operation, the ink remaining in the nozzles 108 are ejected. Therefore, the ink is prevented from being deteriorated in the nozzles 108, and quality of the nozzles 108 for ejecting the ink can be maintained.

Although an example of carrying out the invention has been described, those skilled in the art will appreciate that there are numerous variations and permutations of the liquid ejecting device that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, in the above-described embodiment, the cancellation signal output unit 43 recognizes an error condition when a count of pieces of line data, which are for the dots not yet printed on the sheet P, is greater than a count of pieces of line data for dots to be printed in a remaining printable range in the sheet P. In this regard, the remaining printable range in the sheet P is a range in a page on the sheet P, which excludes the predetermined margin. However, the remaining printable range may include the predetermined margin.

For another example, the actuator unit 21 may not necessarily be inactivated after termination of the printing operation, even when no continuous printing operation is requested, but may be maintained activated.

For another example, the flushing operation may not necessarily be conducted after termination of the printing operation. Alternatively, the maintenance operation may be limited to an extent of a non-eject flushing, in which the inks are restricted from being ejected from the nozzles 108. More specifically, the controller unit 16 may generate non-ejection signals to cause deformation in the piezoelectric layers 141-143 within a predetermined range, in which the ink droplets are restricted from being ejected from the nozzles 108, and outputs the non-ejection signals to the separate electrodes 135. With the non-eject flushing, an amount of the ink to be wasted in the flushing operation can be prevented from being consumed whilst the inks are prevented from being deteriorated in the nozzles 108.

Further, in the above-described embodiment, the nozzle lines in the inkjet head 1 are laid out along the auxiliary scanning direction to be evenly spaced apart from one another. However, the nozzle lines may be laid out along the auxiliary scanning direction at different amounts of intervals in between them. When the nozzle lines are laid out at different amounts of intervals, ejecting of the dots based on the segmented dot pattern data 52 is not conducted at even ejection period but is conducted in the different lengths of ejection periods, which correspond to the distances between the nozzle lines. In other words, in the above-described embodiment, in the first dot pattern data 51 for the line data LD 1/LD2/LD3, the dot data are rearranged in the three pieces of segmented dot pattern data 52, each of which corresponds to one of the evenly scheduled ejection timings t1, t2, t3, due to the evenly maintained distances between the nozzle lines laid out along the auxiliary scanning direction. Therefore, when the nozzle lines are laid out at different amounts of intervals, in the first dot pattern data 51 for the line data LD 1/LD2/LD3, the dot data are rearranged in a plurality of pieces of segmented dot pattern data 52, each of which corresponds to one of unevenly scheduled ejection timings. In this regard, the ejection timings are determined based on a speed to convey the sheet P and distances between the nozzle lines.

Further, in the above-described embodiment, the nozzles 108 in the inkjet heads 1 are arranged in mutually separated (not overlapping) positions along the main scanning direction. However, the nozzles 108 may be arranged in at least partially overlapping positions with one another.

Furthermore, the unimorph-typed piezoelectric actuators in the actuator units 21 in the above-described embodiment may be replaced with bimorph-typed piezoelectric actuators. Alternatively, the inkjet heads 1 may be a thermally ink ejecting device with a heating element, which is configured to eject the inks by heat.

The above-described embodiment may be applied to a recording apparatus, which ejects liquid other than ink. Further, the above-described embodiment may not necessarily be applied to a printer but may be applied to other image recording apparatus such as a facsimile machine or a copier.

What is claimed is:

1. A liquid ejecting device, which is configured to eject droplets of liquid onto a surface of a recording medium to record an image, comprising:

a conveyer, which is configured to convey the recording medium in a conveying direction;

a liquid ejecting head, which includes a plurality of nozzle lines laid out along the conveying direction, each of the nozzle lines including a plurality of nozzles being aligned to an orthogonal direction with respect to the conveying direction, the plurality of nozzles in adjoining nozzle lines being arranged in mutually different positions along the orthogonal direction;

a detector unit, which is configured to detect a rear end of the recording medium being conveyed passing by a predetermined position, the predetermined position being in an upstream position with respect to the liquid ejecting head along the conveying direction;

an image data storage, which is configured to store image data representing the image to be recorded, the image data including dot data, which represents dots to form the image, each of the dots corresponding to a plurality of pixels in the image data arranged in matrix;

a controller, which controls the liquid ejecting head to eject the droplets of liquid from the nozzles at a predetermined timing; and a cancellation signal output unit, which is configured to output cancellation signals to stop ejecting the droplets from the nozzles before the rear end of the recording medium reaches a position opposite from one of the nozzles being arranged in a most upstream position along the conveying direction when an error condition, in which the dots corresponding to the pixels included in the image data are not completely recorded on the recording medium, is recognized, wherein the controller includes:

a creating unit, which is configured to create a plurality of pieces of first dot pattern data based on a plurality of pieces of line data including dot data representing pixels arranged along the orthogonal direction amongst the plurality of pixels in matrix, the first dot pattern data representing the dots rearranged to reflect arrangement of the nozzles, and sum segments extracted from each of the plurality of pieces of the first dot pattern data on basis of a timing to eject the droplets to create a plurality of pieces of second dot pattern data;

a transmission unit, which is configured to transmit the second dot pattern data on basis of the timing to the liquid ejecting head; and a cancellation controller unit, which is configured to stop the creating unit creating the first dot pattern, create at least a piece of second dot pattern data by adding a dot pattern, which omits the ejection of the droplets from the nozzles, to the segments having been extracted from the first dot pattern data by the creating unit, and transmit the created second dot pattern data to the transmission unit, and wherein the controller controls the liquid ejecting head to eject the droplets from the nozzles at the predetermined timing according to the second dot pattern data transmitted from the transmission unit.

2. The liquid ejecting device according to claim 1, wherein the cancellation signal output unit is configured to determine the liquid ejecting device is in the error condition when the detector unit detects the rear end of the recording medium being conveyed passing by the predetermined position and when a count of pieces of the line data in the second dot pattern data, which has been created by the creating unit but not yet transmitted to the liquid ejecting head, is greater than a count of pieces of line data including the dot data for the dots to be recorded in a remaining recordable area in the recording medium.

3. The image ejecting device according to claim 1, wherein the liquid ejecting head comprises:

a fluid channel unit, in which a plurality of branched fluid channels connecting pressure chambers with the nozzles respectively are formed; and an actuator, which is fixed to a surface of the fluid channel unit and comprises a piezoelectric layer, a plurality of separate electrodes arranged on a surface of the piezoelectric layer in positions opposite from the pressure chambers, and a common electrode, to which reference potential is impressed, holding the piezoelectric layer interposed between the separate electrodes and the common electrode; and wherein the controller impresses reference potential to the plurality of separate electrodes after termination of recording the image on the recording medium.

4. The ink ejecting device according to claim 1, wherein the liquid ejecting head comprises:

a fluid channel unit, in which a plurality of branched fluid channels connecting pressure chambers with the nozzles respectively are formed; and an actuator, which is fixed to a surface of the fluid channel unit and comprises a piezoelectric layer, a plurality of separate electrodes arranged on a surface of the piezoelectric layer in positions opposite from the pressure chambers, and a common electrode, to which reference potential is impressed, holding the piezoelectric layer interposed between the separate electrodes and the common electrode; and wherein the controller outputs non-ejection driving signals to cause deformation in the piezoelectric layer within a predetermined range, in which the droplets are restricted from being ejected from the plurality of nozzles, to the plurality of separate electrodes after termination of recording the image on the recording medium.

5. The liquid ejecting device according to claim 1, wherein the controller controls the liquid ejecting head to collaterally eject the droplets from the plurality of nozzles after termination of recording the image on the recording medium.

* * * * *